United States Patent [19]

Suzuki

[11] Patent Number: 4,903,909

[45] Date of Patent: Feb. 27, 1990

[54] BRAKE FOR PAPER ROLL BEARING SHAFT IN PAPER ROLL SUPPORT FRAME OF WEB FEEDER FOR ROTARY PRESS

[75] Inventor: Seiji Suzuki, Yokohama, Japan

[73] Assignee: Kabushiki Kaisha Tokyo Kikai Seisakusho, Tokyo, Japan

[21] Appl. No.: 326,469

[22] Filed: Mar. 21, 1989

Related U.S. Application Data

[63] Continuation of Ser. No. 126,836, Nov. 30, 1987, abandoned.

[30] Foreign Application Priority Data

Dec. 15, 1986 [JP] Japan ..... 61-191782[U]

[51] Int. Cl.[4] ..... B65H 19/00

[52] U.S. Cl. ..... 242/75.4; 242/58.3; 242/75.44; 242/75.47

[58] Field of Search ..... 242/75.4, 75.44, 75.47, 242/58.3

[56] References Cited

U.S. PATENT DOCUMENTS

| | | | |
|---|---|---|---|
| 1,995,722 | 3/1935 | Smith | 242/75.44 |
| 2,782,012 | 2/1957 | Coyne et al. | 200/27 R |
| 2,963,235 | 12/1960 | Pedersen et al. | 242/58.3 |
| 3,062,467 | 11/1962 | Chase et al. | 242/58.3 |
| 3,226,498 | 12/1965 | Carpenter et al. | 200/24 |
| 3,275,761 | 9/1966 | Yakim | 200/27 R |
| 3,342,955 | 9/1967 | Smith et al. | 200/26 |
| 3,647,995 | 3/1972 | Wisely | 200/26 X |
| 3,813,052 | 5/1974 | Swann et al. | 242/58.3 |
| 4,142,167 | 2/1979 | Little et al. | 200/27 R X |

FOREIGN PATENT DOCUMENTS 52215 12/1981 Japan .

*Primary Examiner*—Stuart S. Levy
*Assistant Examiner*—Steven M. duBois
*Attorney, Agent, or Firm*—Richard Bushnell

[57] ABSTRACT

The brake for web bearing shaft in a web support frame of a web feeder for rotary press comprises a pneumatic brake provided individually on a web bearing shaft mounted rotatably on each web support arm of a radial arm member installed on a rotating shaft, a pneumatic circuit for feeding compressed air at every pneumatic brakes, a solenoid valve provided at every pneumatic circuits, a solenoid valve switching means for operating each solenoid valve according to a turning phase of each web support arm. Then, the solenoid valve is a valve provided with manual operation, and the solenoid valve switching means comprises either slip ring having a combination of segment conductors and brushes or segment cam and electric switch operated by the cam.

6 Claims, 3 Drawing Sheets

BRAKE FOR PAPER ROLL BEARING SHAFT IN PAPER ROLL SUPPORT FRAME OF WEB FEEDER FOR ROTARY PRESS

This application is a continuation of application Ser. No. 126,836, filed Nov. 30, 1987, now abandoned.

BACKGROUND OF THE INVENTION

This invention relates to a brake for paper roll bearing shaft in a paper roll support frame of web feeder for rotary press.

A brake for paper roll bearing shaft provided on each paper roll support arm of a radial arm member mounted on a rotating shaft in a paper roll support frame of web feeder for rotary press is usually called a center brake, and its braking force is adjusted fine according to a detection signal from a tension detector provided in a travelling path of web. Then, with reference to a set of paper roll bearing shafts disposed opposite each other, the center brake operates so as to deliver the web during the period from the point in time when the paper roll on the bearing shafts is pasted to the point in time when the next paper roll is pasted through a delivery of the web and then the web is cut to terminate the web delivery, thus braking the bearing shafts, but it does not operate in order to install a paper roll and prepare for web pasting, after the termination of the web delivery and while a new paper roll is installed and then the new paper roll is pasted to the preceding one, thus releasing the bearing shaft rotation from being braked.

Now, therefore, in a prior art center brake working on air pressure, a valve in a pneumatic circuit for actuating and releasing the rotation braking of the paper roll bearing shafts at every paper roll support arms is operated manually by workers or mechanically by a device disclosed, for example, in Japanese Utility Model Publication No. 52215/1981. The device works on gravity, mounted on the turning paper roll support arms and thus operates the valve according to operation of a rod pivoting on a weight. However, since gravity works in one direction at all times, the weight becomes effective or ineffective for the rod to operate the valve depending on a turning phase of the paper roll support arms, therefore a desired braking operation is obtained by properly relating a turning phase of the paper roll support arms with a braking cycle of the paper roll bearing shafts.

In the foregoing prior art, a manual operation of workers entails troublesome valve operation and cannot prevent an erroneous operation perfectly. Then, in the case of gravity utilization, since the rod is pivoted only on a weight according to the turning phase of the paper roll support arms, a dependable valve operation cannot be expected. Further, an opening/closing cycle of the valve is restricted by the turning phase of the paper roll support arms.

SUMMARY OF THE INVENTION

It is the primary object of the present invention to provide a brake for paper roll bearing shaft in paper roll support frame of web feeder for rotary press, small in size and accurate in operation, which is ready to actuate and release a braking motion automatically according to turning positions of paper roll support arms, namely, paper feed operating cycle.

It is another object of the present invention to provide a brake for paper roll bearing shaft in paper roll support frame of web feeder for rotary press, wherein an operation according to web feed operating cycle is free from troublesomeness and erroneous operation, a working efficiency is enhanched accordingly, and a confusion due to lack of a tension at the time of web pasting and delivery of web is prevented.

The brake for paper roll bearing shaft in paper roll support frame of web feeder for rotary press according to the present invention comprises a pneumatic brake provided individually on paper roll bearing shafts mounted rotatably on each paper roll support arm of a radial arm member installed on a rotary shaft, a pneumatic circuit for feeding compressed air at every pneumatic brakes, a solenoid valve provided at every pneumatic circuits, and a solenoid valve switching means for operating each solenoid valve according to a turning phase of each paper roll support arm. Then, the solenoid valve is provided with a hand operation means, the solenoid valve switching means comprises a slip ring having a combination of segment conductors and brushes, or a segment cam and electric switches operated by the cam.

The aforementioned solenoid valve switching means operates a power circuit to the coil of the solenoid valve according to a rotation of the paper roll support frame of a web feeder for rotary press, namely a turning of each paper roll support arm of the radial arm member, and therefore correspondingly to a turning phase of the paper roll support arms. Then, the paper roll bearing shaft rotation is braked or released by a pneumatic brake according to operation of the solenoid valve through a switching circuit of the device.

Accordingly, in an operation cycle including installation of a paper roll to each paper roll support arm of the radial arm member in the paper roll support frame of a web feeder for rotary press, web pasting of the paper roll, web delivery and cutting of an preceding web, a desired braking cycle of the paper roll bearing shafts can be obtained by providing the solenoid valve switching means according to the braking or releasing of the paper roll bearing shaft rotation necessary at each turning phase of the paper roll support arms.

BRIEF DESCRIPTION OF THE DRAWINGS

Other features and advantages of the present invention will be apparent from the following description taken in connection with the accompanying drawings, wherein.

DESCRIPTION OF THE PREFERRED EMBODIMENTS

Figure 1:
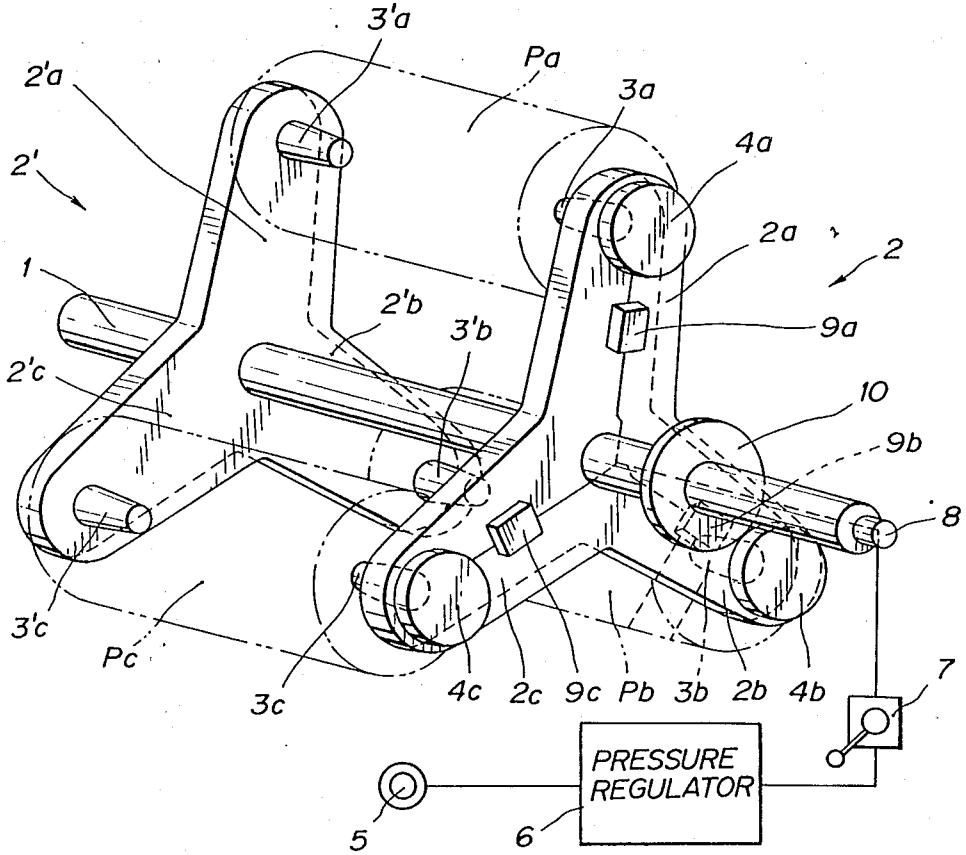
FIG. 1 is a perspective view of a paper roll support frame of a web feeder for rotary press which is provided with a brake for paper roll bearing shaft according to the invention.

Referring now to FIG. 1, there is shown a paper roll support frame of a web feeder for rotary press which is provided with a brake for paper roll bearing shafts.

The paper roll support frame comprises a rotating shaft 1 and a set of radial arm members 2, 2' fixed thereon facing each other, and paper roll support arms 2a, 2b, 2c; 2'a, 2'b, 2'c (spiders with a 120-degree central angles as illustrated) elongating radially at equal central angles are formed each on radial arm members 2, 2'. Paper roll bearing shafts 3a, 3b, 3c; 3'a, 3'b, 3'c are mounted rotatably on the nose portion of each paper roll support arm, and the paper roll bearing shafts 3a, 3b, 3c of the radial arm member 2 on one side and the paper roll bearing shafts 3'a, 3'b, 3'c of the radial arm member 2' on the other side each face each other on the same axis parallel with the rotating shaft 1. Then, paper roll, Pa, Pb, Pc are installed on each set of paper roll bearing shafts facing each other.

Pneumatic brakes 4a, 4b, 4c are provided respectively on the paper roll bearing shafts 3a, 3b, 3c of at least one of the radial arm members 2, and the rotations of the paper roll baring shafts 3a, 3b, 3c are each braked independently with respect to the paper roll support arms 2a, 2b, 2c when the brakes are actuated.

A compressed air piping from a compressed air source 5 is connected to a rotary joint 8 provided on the rotating shaft 1 through a pressure regulator 6 and a manually-operated valve 7, passes further through the rotating shaft 1, diverges along each of the paper roll support arms 2a, 2b, 2c and is connected to each of the pneumatic brakes 4a, 4b, 4c by way of solenoid valves 9a, 9b, 9c provided on a suitable portion of each arm.

The solenoid valve may be preferably a valve with manual operation, and even where the paper roll support arms are not present in a pneumatic brake operating brake A, it can be opened arbitrarily through manual operation to actuate the pneumatic brakes, and thus an arrangement is such that the valve will be opened whenever the paper roll support arms go into the pneumatic brake operating zone A irrespective of manual operation.

The pressure regulator 6 operates to regulate air pressure to the pneumatic brakes 4a, 4b, 4c through a detection signal from a tension detector (not illustrated) provided in a web travelling path according to a web tention.

Figure 2:
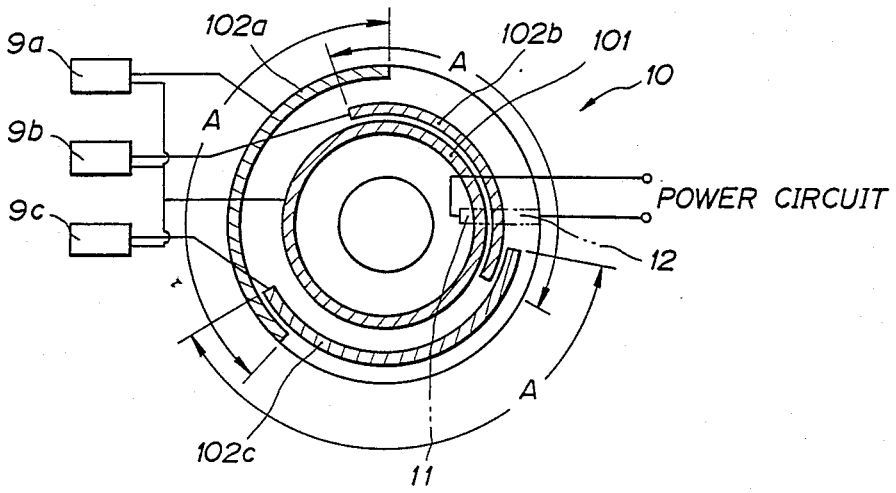
FIG. 2 is a schematic elevation view of a solenoid valve switching device comprising a slip ring which is provided on the paper roll support frame shown in FIG. 1.

A slip ring 10 shown in FIG. 2 which is fixed on the rotating shaft 1 is interposed in a power circuit in coils of the solenoid valves 9a, 9b, 9c. The slip ring 10 comprises a single ring conductor 101 rotating together with the radial arm member 2, coming in contact with one brush 11 during its full rotation and connected to one end of all coils, and segment conductors 102a, 102b, 102c coming in contact with another brush 12, divided for each solenoid valve and connected to another end of each coil, each segment conductor being placed peripherally to cover the desired pneumatic brake operating zone A in one rotation of the paper roll support arm. Accordingly, there may be a case where both end portions are overlapped on end portions of the adjacent segment conductors as illustrated.

Figure 3:
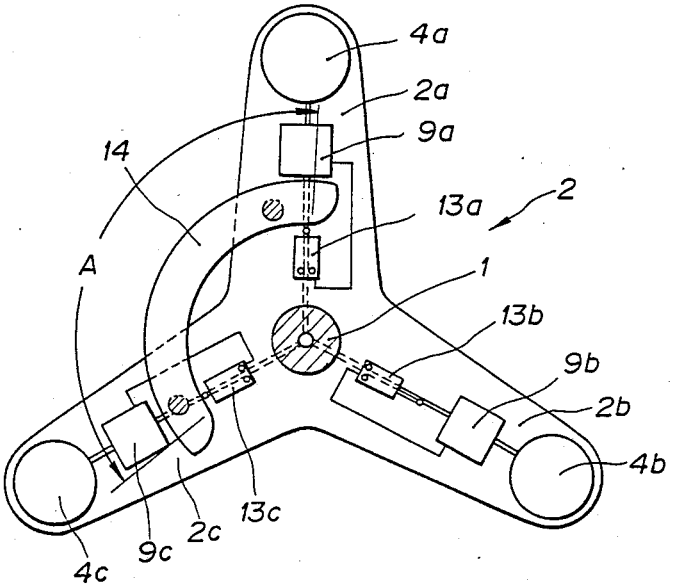
FIG. 3 is a schematic elevation view of another type of solenoid valve switching device comprising a segment cam and electric switches which is provided on the paper roll support frame.

Another type of solenoid valve switching means different from the solenoid valve switching means (slip ring 10) shown in FIG. 2 is shown in FIG. 3. Electric switches 13a, 13b, 13c such as, for example, limit switch or proximity switch are mounted to the paper roll support arms 2a, 2b, 2c of the radial arm member 2 respectively on the same circumference around the axis of the rotating shaft 1, and a segment cam 14 for operating the turning electric switches is fixed on a body (not indicated) of the web feeder for rotary press with the paper roll support frame installed thereon, which is positioned on a turning path of the electric switches generated by a rotation of the radial arm member 2, and covers the desired pneumatic brake operating zone A in one turning of the paper roll support arm.

The electric switches 13a, 13b, 13c are interposed in power circuits of coils of the solenoid valves 9a, 9b, 9c respectively, and kept close while, for example, coming in contact with or being near the segment cam 14, but kept open under the other conditions.

Whichever aforementioned solenoid valve switching means is used, each of the solenoid valves 9a, 9b, 9c is excited to open, and thus each of the corresponding pneumatic brakes 4a, 4b, 4c is actuated.

The aforementioned device will be described with reference to its operation and function.

In FIG. 4, the radial arm members 2, 2' of the paper roll support frame are rotated counterclockwise by the rotating shaft 1, or the paper roll support arms 2a, 2b, 2c, 2'a, 2'b, 2'c are turned each. Then, the power circuit for coil of the solenoid valve of the arm is closed by slip ring and brush or segment cam and electric switch while each turning paper roll support arm is present in the pneumatic brake operating zone A, the solenoid valve is opened, and the pneumatic brake of the paper roll bearing shafts is actuated by a pressure regulated by the pressure regulator 6. As a result, the paper roll bearing shafts are braked for rotation by a force corresponding to a tension of the travelling web. As a matter of course, the power circuit for coil of the solenoid valve of the arm is opened by slip ring and brush or segment cam and electric switch while each turning paper roll support arm is not present in the pneumatic brake operating zone A, the solenoid valve is closed, and the pneumatic brake of the web bearing shafts is released, therefore the paper roll bearing shafts become rotatable.

Referring to a turning phase state shown in Figure 4(*a*), it shows the state where a rotary press is started for operation, a paper roll is installed on all the three paper roll support arms normally, the paper roll support arms 2a, 2'a are in a paper feeding first position and in the pneumatic brake operating zone A and positioned almost horizontally, the paper roll bearing shaft 3a viz. the paper roll Pa is subjected to rotational braking corresponding to a tension of a travelling web Wa, and the web Wa is given a desired tension and delivered from the paper roll Pa. On the other hand, since the paper roll support arms 2b, 2'b, 2c, 2'c are not present in the pneumatic brake operating zone A, the paper roll bearing shafts 3b, 3c are not subjected to a braking and thus ready for rotation, and the paper rolls Pb, Pc installed thereon are already prepared for web pasting.

In this Figure the arms 2b, 2'b are located in a paper roll loading third position mentioned below and the arm 2c, 2'c are located in an intermediate position.

Figure 4A:
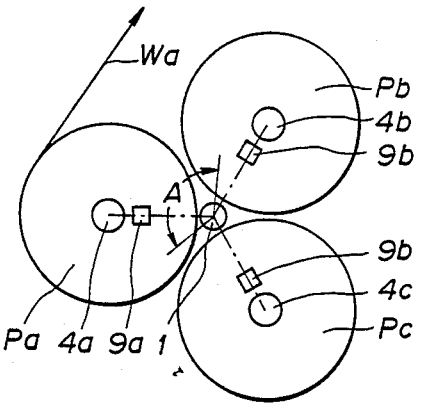
FIG. 4 (*a*) to (*f*) are operational diagrams of the paper roll support frame shown in FIG. 1.
Figure 4B:
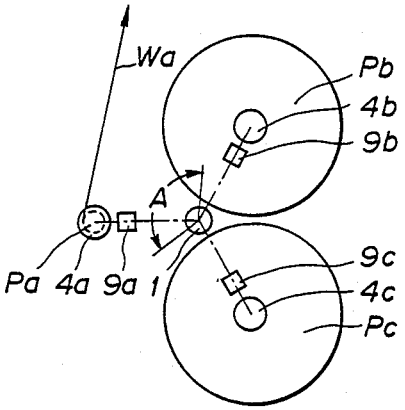

In the turning phase state shown in FIG. 4(*a*), a consumption of the web Wa increase with printing, and a state where the web pasting will be necessary before long is shown in FIG. 4(b).

Figure 4C:
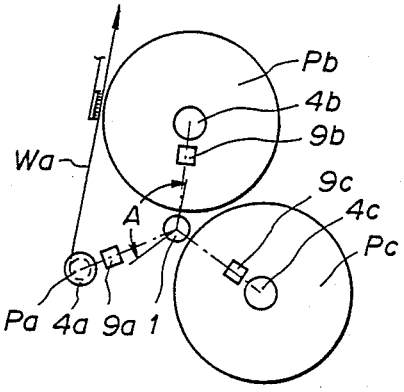

When web pasting of the paper roll Pb to the web Wa being delivered is necessary, each paper roll support arm is turned to a turning phase immediately before the web pasting as shown in FIG. 4(c). The paper roll support arms 2b, 2'b are now in a web pasting second position and in the pneumatic brake operating zone A in addition to paper roll support arms 2a, 2'a. Under such phase state, the paper roll bearing shaft 3b or the paper roll Pb will be subjected to braking. The paper roll Pb is rotated under this state so that its peripheral speed is equal to a traveling speed of the web Wa and is then pasted to the web Wa, and at the same time the web Wa is cut at the position somewhat upstream of the web pasting position.

Figure 4D:
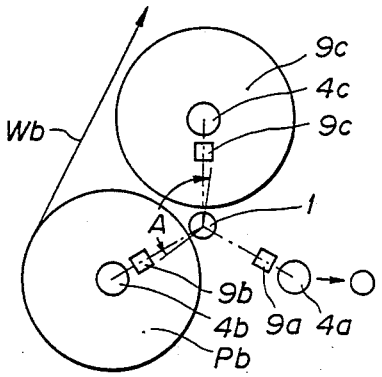

Each paper roll support arm is then turned, the paper roll support arm 2a, 2'a go out of the pneumatic brake operating zone A into a paper roll loading or replacing zone B, and at least the paper roll support arms 2b, 2'b go into a turning phase state as if they were in the pneumatic brake operating zone A as shown in FIG. 4(d) irrespective of the situation of the paper roll support arms 2c, 2'c. Under such state, a web Wb is continuously given a desired tension from the paper roll Pb and delivered, the paper roll bearing shaft 3a becomes rotatable, and the core of the paper roll Pa is removed from the paper roll support arms 2a, 2'a.

Figure 4E:
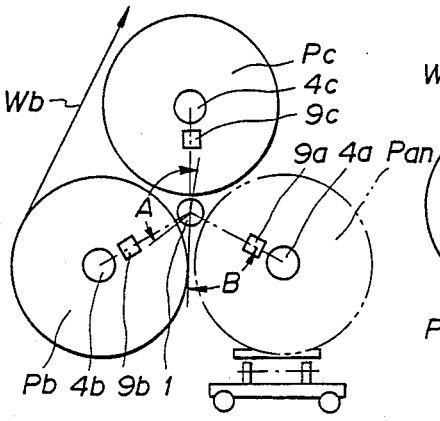

Then, a new paper roll Pan carried to a position for installation on a truck running on a traverser as shown in FIG. 4(e) is installed on the paper roll support arms 2a, 2'a from which the core of the paper roll Pa has been removed, under the same turning phase state.

Then, while a height of mounting surface of the truck is constant, the new paper roll Pan varies in size, therefore the paper roll support arms 2a, 2'a must be placed into a turning phase state where a height of the paper roll bearing shafts of the paper roll support arms 2a, 2'a on which the new paper roll Pan is to be installed is aligned to a core height of the new paper roll Pan. A range in which such paper roll support arms 2a, 2'a are positioned is the aforementioned paper roll replacing zone B, and FIG. 4(e) indicates the case where the new paper roll Pan has a maximum diameter.

Figure 4F:
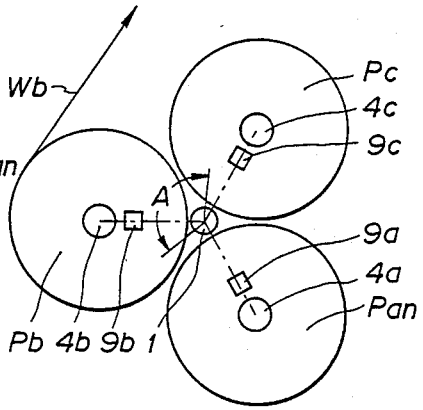

After the new paper roll Pan is installed, each paper roll support arm turns and shifts into a turning phase state shown in FIG. 4(f) which is turned 120 degrees counterclockwise from the turning phase state in FIG. 4(a). This turning phase state is essentially identical with the state shown in FIG. 4(a).

Preparations for web pasting of the new paper roll Pan are made normally under such state, however, the paper roll support arms 2a, 2'a will be turned properly for the easiest preparations for web pasting provided that the paper roll support arms 2b, 2'b are in the pneumatic brake operating zone A, depending on various conditions such as a size of the new paper roll Pan and the like.

Thus the above-described cycle is repeated.

The solenoid valves 9a, 9b, 9c are provided with manual operation, therefore even in the case the paper roll support arm is not present in the pneumatic brake operating zone A, the pneumatic brake is actuated by opening the solenoid valve manually as occasion demands, and thus the paper roll bearing shafts are braked for rotation. Then, if the paper roll support arm goes in the pneumatic brake operating zone A irrespective of manual operation, the pneumatic brake can be actuated, needless to say, automatically.

In the brake for paper roll bearing shaft in a paper roll support frame of web feeder for rotary press, actuation and release of the braking are carried out automatically according to a turning phase of the paper roll support arm, namely a web feed operation cycle, therefore it is free from troublesome or erroneous operation resulting from the aforementioned cycle unlike in the case of brake by manual operation, work efficiency will be enhanced accordingly, and a confusion arising due to lack of a web tension at the time of web pasting or web delivery can also be prevented effectively.

Still further, a pneumatic brake operated by a solenoid valve is used as the brake, and the solenoid valve operated by a switching unit such as slip ring having a combination of segment conductors and brushes or a segment cam and electric switches is used for automating the operation according to a turning phase of the paper roll support arm, therefore a miniaturization of the brake and dependability of the operation can be expected.

Then, braking in the pneumatic brake operating zone is effected by an opening of the solenoid through closing of the solenoid switching means in the above-described embodiment, however, an engineering change is possible, needless to say, so as to secure the braking operation through properly combining opening and closing of the solenoid valve switching means and opening and closing of the solenoid valve.

While the present invention has been particularly shown and described with reference to preferred embodiments thereof, it will be understood by those skilled in the art that the foregoing and other changes in form and details can be made therein without departing from the spirit and scope of the present invention.

What is claimed is:

1. A brake system for paper roll bearing shafts in a rotatably supported support frame of a web feed for a rotary press, which support frame includes at least two pairs of radial paper roll support arms each with a paper roll bearing shaft rotatably supported therebetween, said frame being rotatable for successively advancing said support arms to a paper feeding first position, a web pasting second position, a paper roll loading third position locating the now-loaded paper roll in position for repeat cycling, said brake system comprising a pneumatic brake on said support frame and individually associated with each paper roll bearing shaft, a pneumatic circuit for feeding compressed air to each of said pneumatic brakes, a plurality of solenoid valves on said support frame and connected in said pneumatic circuit and respectively associated with each of said pneumatic brakes for individually controlling the operation of said brakes, and solenoid valve switching means on said support frame for selectively and individually operating each solenoid valve according to a turning phase of each paper roll support arm, said switching means comprising actuation means for simultaneously energizing two of said solenoid valves during a web pasting operation to maintain tension on spliced webs from two paper rolls mounted on said respective bearing shafts and support arms located with a brake operating zone extending to and between said web pasting second position and said paper feeding first position.

2. A brake system, as defined in claim 1, wherein said switching actuation means comprises at least one segment conductor rotatable with said support frame and extending over an arcuate expanse corresponding to said brake operating zone, and brushes fixed at a predetermined location with respect to said support frame for cooperation with said segment conductor for switching said solenoid valves on and off.

3. A brake system, as defined in claim 1, wherein said switching actuation means comprises electric switches rotatable with said support frame and a segment cam fixed at a predetermined location with respect to said support frame and extending over an arcuate expanse corresponding to said brake operating zone, for cooperation with said electric switched to switch said solenoid vales on and off.

4. A brake system, as defined in claim 1, wherein each of said solenoid valves comprises manually operable means for actuating the valve.

5. A brake system, as defined in claim 2, wherein each of said solenoid valves comprises manually operable means for actuating the valve.

6. A brake system, as defined in claim 3, wherein each of said solenoid valves comprises manually operable means for actuating the valve.

* * * * *